United States Patent [19]

Noguchi et al.

[11] 4,265,710

[45] May 5, 1981

[54] PROCESS FOR CALCINING COKE

[75] Inventors: Kosaku Noguchi, Tokyo; Nobuyuki Komi, Mitaka, both of Japan

[73] Assignee: Koa Oil Company, Limited, Tokyo, Japan

[21] Appl. No.: 57,674

[22] Filed: Jul. 16, 1979

[30] Foreign Application Priority Data

Mar. 8, 1979 [JP] Japan ..... 54-26144

[51] Int. Cl.[3] ..... C10B 7/00

[52] U.S. Cl. ..... 201/27; 201/33; 201/37; 201/44; 423/448

[58] Field of Search ..... 423/448, 449; 201/15, 201/16, 27, 33, 34, 37, 44

[56] References Cited

U.S. PATENT DOCUMENTS

| | | | |
|---|---|---|---|
| 4,100,265 | 7/1978 | Yoshimura et al. | 201/44 |
| 4,115,202 | 9/1978 | Lorenz et al. | 201/34 |
| 4,176,010 | 11/1979 | Dudek et al. | 201/33 |

*Primary Examiner*—Norman Yudkoff

*Attorney, Agent, or Firm*—Wenderoth, Lind & Ponack

[57] ABSTRACT

Process for calcining green coke in at least three heating stages, which comprises preheating the green coke in the first stage, preliminarily calcining the coke in the second stage, cooling the coke; and calcining the coke in the third stage, volatile matter from the second stage being burned during the third stage. The product coke is suitable for preparing graphite electrodes.

10 Claims, 2 Drawing Figures

PROCESS FOR CALCINING COKE

BACKGROUND OF THE INVENTION

The present invention relates generally to a process for calcining green coke obtained by a delayed coking process, and more specifically to a process for producing, with high thermal efficiency, high-grade coke suitable for use in the preparation of graphite electrodes.

Preparation of green coke from heavy oils of petroleum origin such as residual oils of catalytic cracking and thermal cracking, straight run residual oils and tar of thermal cracking, coal tar pitch or mixtures thereof, by a delayed coking process is known in the art. The green coke produced by this process still contains a significant quantity of moisture and volatile matter. Accordingly, there is also known a process for calcining the produced green coke in order to remove the moisture and volatile matter from the green coke and to densify the same, thereby producing a carbon material having a high density and a low coefficient of thermal expansion which is suitable for use as an electrode material for steel-making, aluminum smelting or the like, or a carbon material for other shaped articles.

Calcining of such green coke is carried out in heating furnaces such as a rotary kiln, a rotary hearth, and a shaft kiln in a single stage, or in two stages by further providing a preheating furnace.

We have found, as a result of our research on the unit stages in the calcination of coke, that one or two stages of heating furnaces are insufficient, and that at least three stages of heating furnaces are necessary in order to produce high-grade coke efficiently, and have developed a process for calcining coke (Japanese Patent Laid-Open Publication No. 10301/1979, U.S. patent application Ser. No. 890,707). More particularly, this calcining process comprises calcining green coke obtained by a delayed coking process in heating furnaces of at least three stages connected in series, in which the control of temperature and the adjustment of the atmosphere in the respective furnaces can be independently carried out, which process comprises carrying out the following steps in the respective furnaces in the indicated order:

(a) evaporating the water contained in the green coke, and drying and preheating the coke;

(b) distilling off and burning the volatile matter in the dried coke; and (c) heating and calcining the coke from the step (b).

As far as we are aware, the calcined coke obtained by this process is not fully satisfactory as coke for artificial graphite electrodes which needs to be of particularly high grade. That is, there remains much room for improvement with respect to high density and low coefficient of thermal expansion, which are the most important properties required of coke for artificial graphite electrodes.

On the other hand, it has been found that cooling in an intermediate stage in the calcination of coke is highly effective in reducing the coefficient of thermal expansion of the calcined coke and increasing the density, particularly the true density thereof, and a process has been developed for producing high-grade coke. This process for calcining coke comprises first calcining green coke obtained by a delayed coking process at a temperature lower than an ordinary calcining temperature, cooling once the calcined coke, and thereafter calcining the coke again at a temperature in the ordinary calcining temperature range (as disclosed in U.S. Pat. No. 4,100,265, July 11, 1978). Although it is not sufficiently clear why the coefficient of thermal expansion of the calcined coke is reduced by intermediate cooling, a possible reason may be that some fine cracks are formed in the coke during the process wherein the coke, after being heated to a temperature of 600° to 1000° C., is subjected to intermediate cooling and then to reheating, which cracks are considered to absorb expansion due to heating, resulting in the reduction of the overall coefficient of thermal expansion of the coke. The true density of the calcined coke is increased presumably because rapid evaporation of volatile matter and formation of a porous structure which occurs as a result thereof are suppressed by the intermediate cooling in the above specified temperature range.

It may appear that calcined coke of higher grade can be obtained by applying this concept to the process disclosed in the aforementioned U.S. patent application Ser. No. 890,707 (hereinafter referred to as "original three-stage process"), i.e., by once cooling the preliminarily calcined coke from the step (b) in the original three-stage process, and then calcining the coke in the step (c). However, this is not as easy as might be expected because, in order to once cool the preliminarily calcined coke from the step (b), then to reheat the coke to a temperature equal to the temperature of the outlet of the furnace for the step (b), and then further to supply heat required for the final calcination, the heating furnace for the step (c) will be too heavily loaded, and the quantity of the sensible heat of the waste gas obtained by the increased load will be so great that it cannot be consumed in the entire calcination system. Thus, the application of the original three-stage process to the two-stage calcining process according to the aforementioned U.S. Pat. No. 4,100,265, which comprises intermediate cooling, has been considered unpractical.

As a result of our extended research, however, it has been found that, by suppressing to a minimum the combustion of the volatile matter evaporated in the step (b) in the original three-stage process described above, and, instead of using the waste gas from the step (b) as a gas for drying and preheating the coke in the step (a) as in the original three-stage process, introducing this waste gas into the step (c) where the gas is burned and utilized as a heat source for the final calcination of the coke, the overall sensible heat of the waste gas is not greatly increased, even if the heat load in the step (c) is increased, and thus can be utilized in the system.

It has further been found that, by suppressing the combustion of the volatile matter in the step (b), it becomes easier to control the temperature at the outlet through which the calcined coke from the step (b) is discharged. It should be noted that this control is the most important problem encountered in the two-stage calcining process. In order to suppress the combustion of the volatile matter in the step (b), it is sufficient to introduce air only in the minimum quantity required for the combustion of fuel to generate heat necessary for the preliminary calcination in the step (b), and to maintain the system under a non-oxidizing atmosphere.

SUMMARY OF THE INVENTION

On the basis of the above considerations, the present invention aims at improvements in a two-stage calcining process comprising intermediate cooling so that the process can be practiced on a commercial scale.

More specifically, the process for calcining coke according to the present invention is a process for calcining green coke obtained by a delayed coking process in heating furnaces of at least three stages connected in series, in which the control of temperature and the adjustment of the atmosphere in the respective furnaces can be independently carried out, which process comprises carrying out the following steps in the respective furnaces in the indicated order:

(a) evaporating the water contained in the green coke, and drying and preheating the coke;

(b) distilling off the volatile matter from the dried coke; and (c) burning the volatile matter from the step (b), and calcining the coke, the coke from the step (b), after being once cooled, being introduced into the step (c).

The present invention will be further described with reference to the accompanying drawing which shows an example wherein rotary kilns are used as heating furnaces.

DETAILED DESCRIPTION

The numerical values set forth hereinafter are only typical ones, and, in particular, the temperature and retention time values indicate standard ranges. Of course, these values can be appropriately varied depending on the properties of the green coke and the properties of the calcined coke desired.

Figure 1:
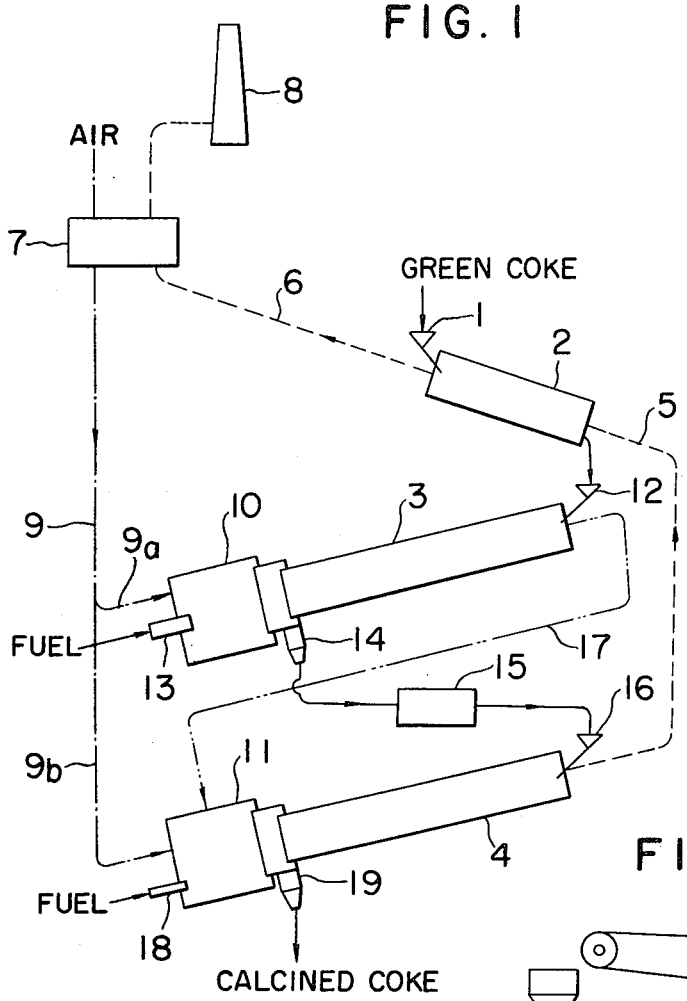
FIG. 1 is a flow chart illustrating one example of the process of the present invention using rotary kilns as heating furnaces, wherein solid lines, one-dot chain lines, the two-dot chain line, and the broken line respectively indicate passages for coke, preheated air, waste gas containing volatile matter, and burned waste gas.

Referring to FIG. 1, the green coke obtained by a delayed coking process is dressed into the desired particle size distribution, for example, such that about 25% is not greater than 3 mesh, about 75% is about 3 mesh, and the maximum particle diameter is not greater than 70 mm. Then, the coke is introduced into a drying and preheating kiln 2 through a raw material feeder 1.

Figure 2:
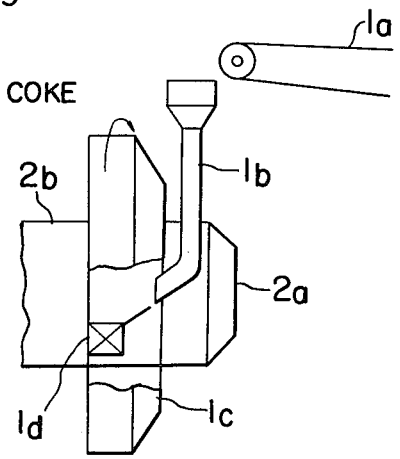
FIG. 2 is a partial side view illustrating an arrangement of a raw material feeder 1 provided in a kiln 2.

The raw material feeder 1 may be of a type wherein a hopper chute is directly inserted into the kiln from the upper end thereof. In order to ensure a better airtightness, as is shown in FIG. 2, it is preferable that the feeder be of such a type that raw material coke is introduced into an annular raw material reservoir 1*c* having a diameter greater than that of the kiln body 2*b* in the neighbourhood of the upper end 2*a* of the kiln, through a conveyor 1*a* and a hopper chute 1*b*, and a trough 1*d* communicating with the kiln body 2*b* is provided, for example, at four portions within the reservoir 1*c*. The raw material is charged into the kiln through the troughs.

The green coke typically has a water content of 7 to 10% (by weight, as in all percentages hereinafter), a volatile matter content of 6 to 10% (according to JIS M8812), and an apparent density of 0.80 to 0.95 g/cm$^3$. The green coke in the kiln 2 is heated to a temperature of 300° to 400° C. by a hot gas (which is at a temperature between about 900° to 1,200° C.) introduced into the kiln 2 through a duct 5 from a final calcining kiln 4 as hereinafter described. As a result, preheating of the coke is carried out with evaporation of the water.

The inclination angle of the kiln 2 is of the order of 1.2 to 3.0 degrees, and the inner diameter, the total length, and the rotational speed of the kiln are selected so as to ensure a retention time of 10 to 30 minutes. By way of example, an inner diameter of 2.3 m, a total length of 20 m, and a rotational speed of 0.5 to 1.0 rpm are adopted for a green coke charge of 10 tons/hr.

The hot gas leaving the kiln 2 is still at a temperature of about 400° to 600° C., which gas is introduced into an air preheater 7 through a duct 6 where the gas undergoes a heat exchange with air, and the gas itself is cooled to a temperature of about 200° to 300° C. and then discharged outside of the system through a chimney 8, while the air is preheated to a temperature of 200° to 400° C. The preheated air is introduced into the combustion chamber 10 of a preliminary calcining kiln 3 and the combustion chamber 11 of the final calcining kiln 4 through a piping 9 (9*a*, 9*b*). Further, an air inlet (not shown) is provided at the base of the chimney 8 so as to control the quantity of air introduced thereby to adjust the pressure in the chimney, for example, to −20 mm $H_2O$, or, if desired, from the standpoint of the pressure balance between the respective parts in the system, an induced draft fan is provided in the duct midway between the outlet of the air preheater through which waste gas is discharged and the chimney.

The coke preheated to a temperature of 300° to 400° C. in the drying and preheating kiln 2 is introduced into the preliminary calcining kiln 3, through a coke feeding device 12, where fuel is burned by a burner 13 with the preheated air from the piping 9*a*, and the volatile matter is distilled off the coke by heat due to the combustion of the fuel, the coke being heated to a temperature of about 600° to 1,000° C. In this temperature range the volatile matter contained in the coke is dispersed, and the coke rapidly shrinks. Thus, whether or not the temperature of the preliminary calcining kiln is maintained and controlled in this range critically affects the quality of the product coke.

The coke feeding device 12 is of almost the same type as the raw material feeder 1. Ordinarily, the inlet end of the kiln 3 is disposed immediately below the outlet end of the kiln 2, and the preheated coke from the kiln 2 is directly dropped by gravity into an annular raw material reservoir (not shown, corresponding to the reservoir 1*c* of FIG. 2) of the coke feeding device 12 of the kiln 3 through a conduit. If such an arrangement is not appropriate, the transportation between the kilns may be carried out by means of a steel belt conveyor or a moving hopper.

The combustion chamber 10 has a construction in which the discharge opening for the combustion gas is connected directly to the outlet of the kiln. A burner which can be used as the burner 13 is not limited with respect to fuel and type. Particularly, a short flame premixing type gas burner wherein a fuel gas and air for combustion are uniformly mixed, and the mixture is injected through a nozzle for combustion thereof is preferable for the reason that wasteful combustion of the coke and the volatile matter can be avoided.

The quantity of the preheated air introduced into the combustion chamber 10 from the piping 9*a* is controlled within the range of from the minimum quantity required for the combustion of fuel up to 10% in excess thereof so as to maintain the kiln 3 under a substantially non-oxidizing atmosphere and minimize the combustion of fuel. Further, in order to prevent the formation of ring-shaped adhesive materials (coke ring), regular or irregular shapes and arrangements of lifters on the surface of the insulating refractories may be provided within the kiln, and the coke is thereby agitated and heated as thoroughly as possible to prevent the aggregation and adhesion of coke particles due to the volatile matter, thus suppressing the formation of ring-shaped adhesive materials.

The inclination angle of the kiln 3 is about 1.2 to 3.0 degrees, and an appropriate retention time is between about 30 and 90 minutes. The flow direction of combustion gas is not limited to a counter flow relative to that of the coke as shown in FIG. 1, but may be a parallel or concurrent flow. However, in order to increase the thermal efficiency, thereby to distill off the volatile matter efficiently in an intermediate zone, and to control the coke calcining temperature, a counter flow as shown in the figure is preferable.

Then, the coke heated to a temperature of about 600° to 1,000° C. is withdrawn through a withdrawal device 14 of the kiln 3 and introduced into an intermediate cooling zone 15 where the coke is subjected to natural cooling or forced cooling, for example, by spraying with water, to a temperature of from room temperature to 200° C., preferably to a temperature not exceeding 100° C. In order to prevent the oxidation of the coke in the cooling process, the cooling rate is preferably controlled to be not lower than 100° C./hr. The coke thus cooled is introduced into the final calcining kiln 4 through a coke feeding device 16.

On the other hand, the waste gas containing the volatile matter from the kiln 3 is introduced into the combustion chamber 11 of the kiln 4 through a piping 17, where the waste gas is burned by the preheated air from the piping **9*b*, and the combustion gas is utilized to heat the coke introduced into the kiln 4 to a calcining temperature of 1,200° to 1,500° C. for calcination. In order to completely burn, in the combustion chamber 11, the waste gas containing the volatile matter from the piping 17, the waste gas is thoroughly mixed with air by blowing the gas in such a manner that the gas stream contacts the stream of the preheated air introduced through the piping 9*b* perpendicularly thereto in the combustion chamber 11 or such that the waste gas creates a turbulence within the combustion chamber 11**.

The combustion chamber 11 is provided with a burner 18 for burning ordinary fuel which is used at the start of the operation and also for heating auxiliary fuel required for the control of temperature.

The kiln 4 is inclined at an angle of 1.2 to 3.0 degrees, and the total retention time of the coke is between 30 and 90 minutes. In this kiln 4, the coke is maintained at the calcining temperature for about 10 to about 30 minutes.

The calcined coke is withdrawn as a product through a withdrawal device 19 positioned before the combustion chamber 11. On the other hand, the waste combustion gas from the kiln 4 is introduced into the drying and preheating kiln 2 through the duct 5, and utilized as a heat source. Ordinarily, the withdrawn coke is introduced into a cooler of rotary kiln type which is provided with a spray nozzle for cooling water therein, and cooled by water directly sprayed thereon. If desired, the coke may be cooled by a gas.

The flow rate of materials and temperature distribution respectively, at various positions in the drawing, per ton of green coke, are shown in the following table by way of example.

| Position No. | Flowing material | Temperature (°C.) | Flow quantity | |
|---|---|---|---|---|
| 1 | Green coke | Room temperature | 1 | ton |
| 12 | Preheated coke | 400 | 0.97 | " |
| 14 | Preliminarily calcined coke | 800 | 0.86 | " |
| 16 | Intermediately cooled coke | 80 | 0.86 | " |
| 19 | Final calcined coke | 1,350 | 0.85 | " |
| 9 | Preheated air | 250 | 1,203 | $Nm^3$ |
| 9a | " | " | 247 | " |
| 9b | " | " | 956 | " |
| 17 | Waste gas containing volatile matter | 900 | 337 | " |
| 5 | Waste combustion gas | 1,000 | 1,301 | " |
| 6 | " | 420 | 1,305 | " |
| 13 | Fuel (calorific value 8,800 kcal/kg) | — | 25 | Kg |
| 18 | Fuel (calorific value 8,800 kcal/kg) | — | 6 | " |

The typical properties of the calcined coke thus obtained and those of the calcined coke obtained without intermediate cooling are shown below.

| | With intermediate cooling | Without intermediate cooling |
|---|---|---|
| Apparent density ($g/cm^3$) | 1.42 | 1.42 |
| True density ($g/cm^3$) | 2.169 | 2.110 |
| Coefficient of thermal expansion* (roasted at 1,000° C.) ($\times 10^{-6}$/°C.) | 1.1 | 1.2 |
| Coefficient of thermal expansion* (graphitized at 2,600° C.) ($\times 10^{-6}$/°C.) | 0.7 | 0.8 |

*The coefficient of linear thermal expansion was determined as follows.

The calcined coke was pulverized, and 92% of the particles having a particle size of above 200 mesh and 8% of the particles having a particle size below 200 mesh were mixed. 100 parts of this mixture was mixed with 25 parts of coal tar binder pitch (of a softening point of 90.3° C., a benzene insoluble content of 19.8%, a quinoline insoluble content of 4.4%, a volatile matter content of 62.7%, and a fixed carbon content of 53.2%), and the mixture was heated, kneaded and mold-shaped into two molded articles, of which one was roasted at 1,000° C., and the other was graphitized at 2,600° C. Test pieces (rods 5 mm in diameter and about 50 mm in length) prepared from these molded articles were tested at temperatures over a range of 30° to 100° C.

In the above described example, a rotary kiln was used for each of the three heating furnaces. However, a part or all of these rotary kilns may also be substituted by a rotary hearth, a retort, or a shaft kiln. It is preferable, however, that a rotary kiln be used for each of the preliminary calcining kiln and the final calcining kiln for the reasons that the combustion of the volatile matter can be suppressed, that uniform calcination of coke can be carried out, and that the process operation can be facilitated.

In addition, it is most preferable to use three heating furnaces from the standpoint of apparatus economy while the independent controllability of the respective furnaces is maintained. If necessary, however, the respective stages or steps can be, of course, further divided into stages or steps with a plurality of furnaces.

As is apparent from the foregoing, the process for calcining coke according to the present invention has the following advantages.

(1) By maintaining the independent states of the respective stages achieved by the three-stage process disclosed in U.S. Patent Application Ser. No. 890,707, and controlling the respective stages of the green coke calcination independently from each other, the optimum conditions for producing high-grade coke can be realized while wasteful combustion of the product coke can be suppressed.

(2) By adopting intermediate cooling, it is possible to produce high-grade coke which is most suitable for use as a graphite electrode.

(3) By utilizing the heat of combustion of the volatile matter effectively in the system, the overall increase in quantity of fuel used can be controlled within a reasonable range in spite of the adoption of intermediate cooling. For example, the quantity of fuel used can be reduced by about 60% in comparison with that required when the coke is subjected to intermediate cooling between the second and third steps in the process disclosed in the aforementioned U.S. Patent Application Ser. No. 890,707.

Thus, the most advantageous feature of the present invention resides in that it has succeeded in the commercialization of a two-stage calcining process comprising intermediate cooling, which has been difficult to realize because of the limitations from the standpoint of economy, particularly of heat economy, although coke of high quality can be obtained thereby.

Further, the above described apparatus for use for the process of the present invention can also be used for a process for calcining coke comprising no intermediate cooling. Although the quality of the product coke is sacrificed in such a case, improved thermal efficiency and operation conditions are maintained, and better results can be obtained even with respect to the quality of the product coke as compared with the conventional process for calcining coke using one or two furnaces.

What is claimed is:

1. A process for calcining green coke, obtained by a delayed coking process, in at least three stages of heating furnaces which are connected in series, the control of the temperature and the adjustment of the atmosphere in each furnace being independently carried out, which process comprises carrying out, in the respective furnaces in the below indicated order, the steps of:

(a) in the first stage, evaporating the water contained in the green coke, drying the resultant coke, and preheating the dried coke to a temperature of 300° to 400° C. by means of a gas having a temperature of 900° to 1,200° C. exiting from the below stated third stage, said gas flowing countercurrently with the green coke in the first stage;

(b) in the second stage, distilling off the volatile matter from the preheated coke, and preliminarily calcining the resultant coke at a temperature of 600° to 1,000° C.; and (c) in the third stage, burning the volatile matter resulting from the step (b), and calcining the coke at a temperature of 1,200° to 1,500° C. for 10 to 30 minutes, the coke from the step (b), after being once cooled to a temperature between room temperature and 200° C., being introduced into the step (c).

2. A process as claimed in claim 1, wherein the number of the heating furnaces is three.

3. A process as claimed in claim 2, wherein each heating furnace has a rotary kiln having an inlet for introducing coke and an outlet for discharging coke.

4. A process as claimed in claim 3, wherein regular or irregular shapes and arrangements of lifters are provided on the inner surface of the second rotary kiln.

5. A process as claimed in claim 2, wherein the retention time of the coke in the first furnace is 10 to 30 minutes, that in the second furnace is 30 to 90 minutes, and that in the third furnace is 30 to 90 minutes.

6. A process as claimed in claim 2, wherein air is indirectly heated by hot gas exiting from the first furnace to form preheated air.

7. A process as claimed in claim 6, wherein the preheated air is branched, and one portion thereof is used to burn fuel at the outlet end for discharging coke from the second furnace, the resulting combustion gas being used to heat the coke from the first furnace and distill off the volatile matter from the coke while flowing countercurrently with the coke in the second furnace.

8. A process as claimed in claim 7, wherein the remaining portion of the preheated air is used to burn the volatile matter from the second furnace at the outlet end for discharging coke from the third furnace, the resulting combustion gas being used to calcine the coke in the third furnace.

9. A process as claimed in claim 7, wherein the amount of the preheated air introduced into the second furnace does not exceed 10% in excess of the theoretical quantity of air required to burn the fuel in the second furnace.

10. A process as claimed in claim 2, wherein the coke from the second furnace is cooled by natural or forced cooling to a temperature not exceeding 100° C. at a rate of 100° C./hr or higher.

* * * * *